US011092155B2

(12) United States Patent
Sato et al.

(10) Patent No.: US 11,092,155 B2
(45) Date of Patent: Aug. 17, 2021

(54) SCROLL COMPRESSOR INCLUDING FIXED AND ORBITING SCROLLS HAVING DIFFERENT HEIGHTS AND SURFACE HARDENINGS

(71) Applicant: MITSUBISHI HEAVY INDUSTRIES THERMAL SYSTEMS, LTD., Tokyo (JP)

(72) Inventors: Hajime Sato, Tokyo (JP); Makoto Takeuchi, Tokyo (JP); Genta Yoshikawa, Tokyo (JP); Kazuhide Watanabe, Aichi (JP); Katsuhiro Fujita, Aichi (JP); Takayuki Hagita, Aichi (JP); Takayuki Kuwahara, Aichi (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 101 days.

(21) Appl. No.: 15/552,959

(22) PCT Filed: Mar. 8, 2016

(86) PCT No.: PCT/JP2016/057082

§ 371 (c)(1),
(2) Date: Aug. 23, 2017

(87) PCT Pub. No.: WO2016/143768

PCT Pub. Date: Sep. 15, 2016

(65) Prior Publication Data

US 2018/0038368 A1 Feb. 8, 2018

(30) Foreign Application Priority Data

Mar. 12, 2015 (JP) ..... JP2015-049877

(51) Int. Cl.
*F04C 18/02* (2006.01)
*F04C 29/12* (2006.01)

(52) U.S. Cl.
CPC ..... *F04C 18/0276* (2013.01); *F04C 18/0215* (2013.01); *F04C 29/12* (2013.01);
(Continued)

(58) Field of Classification Search
CPC ..... F04C 18/0215; F04C 18/0276; F04C 2230/41; F04C 2230/92; F04C 2270/16; F04C 29/12
(Continued)

(56) References Cited

U.S. PATENT DOCUMENTS 5,755,898 A * 5/1998 Yamamoto ..... B22D 27/09 148/439
6,746,224 B2 * 6/2004 Itoh ..... F04C 18/0276 418/55.2
(Continued)

FOREIGN PATENT DOCUMENTS

JP 60-17956 B2 5/1985
JP 4-121483 A 4/1992
(Continued)

OTHER PUBLICATIONS

International Search Report and Written Opinion of the International Searching Authority (Forms PCT/ISA/237 and PCT/ISA/210), dated Jun. 14, 2016, for International Application No. PCT/JP2016/057082, with an English translation.
(Continued)

*Primary Examiner* — Mary Davis
*Assistant Examiner* — Paul W Thiede
(74) *Attorney, Agent, or Firm* — Birch, Stewart, Kolasch & Birch LLP

(57) ABSTRACT

A scroll compressor comprising a fixed scroll (15); an orbiting scroll (16) supported in a manner allowing for orbiting motion; a discharge port through which a fluid compressed by the two scrolls (15, 16) is discharged; an end plate step portion (16E) provided on an end plate of the orbiting scroll (16) formed so that a height of the end plate is higher on a center portion side in the direction of a spiral wrap and lower on an outer end side; and a wrap step portion
(Continued)

(15E) provided on a wall portion of the fixed scroll (15) that corresponds to the end plate step portion (16E) so that a height of the wall portion is lower on the center portion side of the spiral and higher on the outer end side; wherein the orbiting scroll (16) is treated for surface hardening and the fixed scroll (15) is not treated for surface hardening.

4 Claims, 5 Drawing Sheets

(52) U.S. Cl.
CPC ..... *F04C 2230/41* (2013.01); *F04C 2230/92* (2013.01); *F04C 2270/16* (2013.01)

(58) Field of Classification Search
USPC ..... 418/55.2, 55.1; 417/310; 148/439
See application file for complete search history.

(56) References Cited

U.S. PATENT DOCUMENTS

| | | | | |
|---|---|---|---|---|
| 7,335,004 | B2 * | 2/2008 | Lee | F04C 18/0215 417/310 |
| 2002/0094290 | A1 | 7/2002 | Fujita et al. | |
| 2005/0053507 | A1 * | 3/2005 | Takeuchi | F04C 18/0215 418/55.1 |
| 2006/0140804 | A1 | 6/2006 | Lee et al. | |
| 2007/0178002 | A1 * | 8/2007 | Hiwata | F04C 18/0215 418/55.2 |
| 2007/0217934 | A1 * | 9/2007 | Tateishi | F04C 18/0215 418/55.1 |

FOREIGN PATENT DOCUMENTS

| | | | |
|---|---|---|---|
| JP | 2002-5052 | A | 1/2002 |
| JP | 2002-213371 | A | 7/2002 |
| JP | 2006-177335 | A | 7/2006 |
| JP | 2007-255191 | A | 10/2007 |
| JP | 2008-151009 | A | 7/2008 |
| JP | 2014-9593 | A | 1/2014 |

OTHER PUBLICATIONS

Office Action dated Oct. 9, 2018 for Japanese Patent Application No. 2015-049877.

* cited by examiner

SCROLL COMPRESSOR INCLUDING FIXED AND ORBITING SCROLLS HAVING DIFFERENT HEIGHTS AND SURFACE HARDENINGS

TECHNICAL FIELD

The present invention relates to a three-dimensional scroll compressor.

BACKGROUND ART

Generally, scroll compressors are provided with a pair of a fixed scroll and an orbiting scroll. The scrolls each include an end plate with a spiral wrap disposed in an upright manner thereon, and the pair of the fixed scroll and the orbiting scroll are engaged by having their spiral wraps (spiral wall portion) disposed in opposition with a 180° phase difference. With this configuration, the scroll compressor can form a sealed compression chamber between the scrolls and compress fluid.

For such scroll compressors, a two-dimensional compression structure is typically adopted in which the wrap height of the spiral wraps of the fixed scroll and the orbiting scroll is constant over the entire length in the spiral direction, a compression chamber is caused to move from the outer circumferential side to the inner circumferential side while gradually having its capacity reduced, and the fluid in the compression chamber is compressed in the circumferential direction of the spiral wraps.

Meanwhile, in order to improve efficiency of the scroll compressor and to achieve downsizing and weight-reduction thereof, a three-dimensional scroll compressor has been provided. Such a three-dimensional scroll compressor has a structure in which a step portion is provided at a predetermined position along the spiral direction on both the blade tip surface and the blade base surface of the spiral wrap of the fixed scroll and the orbiting scroll, such that the step portion forms a boundary at which the wrap height of the spiral wraps transitions from higher on the outer circumferential side to lower on the inner circumferential side, and the height of the compression chamber in the axial direction transitions from higher on the outer circumferential side of the spiral wraps to lower on the inner circumferential side. This structure allows a fluid to be compressed both in the circumferential direction and the height direction of the spiral wraps.

Such three-dimensional scroll compressors are known, an example of which is described in Patent Document 1. In this three-dimensional scroll compressor, an end plate step portion is formed in both a fixed scroll and an orbiting scroll, and a wrap step portion corresponding to the end plate step portion is formed in the spiral wrap of both the fixed scroll and the orbiting scroll.

Another example is described in Patent Document 2. In this three-dimensional scroll compressor, an end plate step portion is provided in a fixed scroll or an orbiting scroll, and a wrap step portion corresponding to the end plate step portion is formed in the spiral wrap of the other scroll.

Typically, to prevent wear and seizure due to contact between the spiral wraps of the scrolls, one or both of the scrolls are treated for surface hardening using a coating or the like. Patent Document 3 describes such an example in which coating is applied to the step portions of the three-dimensional scroll compressor.

CITATION LIST

Patent Documents

Patent Document 1: Japanese Unexamined Patent Application Publication No. 2002-5052A Patent Document 2: Japanese Examined Patent Application Publication No. S60-17956B (see FIG. 8)

Patent Document 3: Japanese Unexamined Patent Application Publication No. 2007-255191A (see [0046])

SUMMARY OF INVENTION

Technical Problems

As in the technology of Patent Document 1, a configuration in which step portions provided on both a fixed scroll and an orbiting scroll have an equal height, results in both scrolls having the same shape. Thus, the effect of surface hardening treatment does not change depending on whether the fixed scroll or the orbiting scroll is treated.

However, after diligent research, the present inventors discovered that when the height of the step portions of the fixed scroll and the orbiting scroll differ from one another, the shape of the scrolls differs, and that depending on whether one of the scrolls is treated for surface hardening or one of the scrolls is treated for surface hardening to have a harder surface than the other scroll, different results can be expected depending on the selection of the scrolls. In other words, they discovered that there is a suitable surface hardening treatment depending on the difference in height of the step portions when considering the contact between the end plate step portion and the wrap step portion.

In a similar manner, as in the technology of Patent Document 2, with a configuration in which an end plate step portion is provided in a fixed scroll or an orbiting scroll, and a wrap step portion corresponding to the end plate step portion is formed in the spiral wrap of the other scroll, the same problems described above are applicable.

In light of the foregoing circumstances, an object of the present invention is to provide a scroll compressor capable of reducing wear via a scroll being suitably treated for surface hardening.

Solution to Problem

A scroll compressor according to an embodiment of the present invention employs the following means to solve the problems described above.

A scroll compressor according to an embodiment of the present invention comprises: a fixed scroll comprising a spiral-shaped wall portion disposed in an upright manner on a side surface of an end plate; an orbiting scroll comprising a spiral-shaped wall portion disposed in an upright manner on a side surface of an end plate, the orbiting scroll being supported in a manner capable of orbiting motion with the two wall portions meshing while being prevented from self rotation; a discharge port through which a fluid compressed by the two scrolls is discharged; an end plate step portion provided on the end plate of one of the two scrolls formed on the side surface so that a height of the end plate is higher on a center portion side in the direction of a spiral of the wall portion and lower on an outer end side; and a wall portion step portion provided on the wall portion of the other of the two scrolls that corresponds to the end plate step portion so that a height of the wall portion is lower on a center portion side of a spiral of the wall portion and higher on an outer end side; wherein the scroll on which the end plate step portion is provided is treated for surface hardening and the other scroll is not treated for surface hardening.

In an embodiment in which the end plate step portion is provided on the fixed scroll or the orbiting scroll and the wall portion step portion is provided on the other scroll, the shape of the fixed scroll and the orbiting scroll are asymmetrical and they do not have the same shape.

During orbiting motion with the fixed scroll and the orbiting scroll in mesh, the wall portion step portion and the end plate step portion are in contact and move relative to one another. The end plate step portion has a larger contact surface area. Accordingly, by treating the end plate step portion for surface hardening, wear of the surface hardening treatment can be significantly prevented, thus preventing seizure.

Additionally, the wall portion provided with the wall portion step portion experiences stress concentration at a root of the wall portion step portion. However, surface hardening treatment increases the surface roughness of the surface, thus the fatigue strength of the root of the wall portion step portion may be reduced. As such, the scroll including the wall portion step portion is not treated for surface hardening.

For the surface hardening treatment, for example, in embodiments in which the fixed scroll and the orbiting scroll are made of an aluminum alloy, hard alumite treatment may be used. Additionally, in embodiments in which the fixed scroll and the orbiting scroll are made of cast iron or iron, phosphate coating or diamond-like coating (DLC) may be used.

For example, in embodiments in which the end plate step portion is provided on the orbiting scroll and the wall portion step portion is provided on the fixed scroll, the orbiting scroll is treated for surface hardening and the fixed scroll is not treated for surface hardening.

A scroll compressor according to another embodiment of the present invention comprises: a fixed scroll comprising a spiral-shaped wall portion disposed in an upright manner on a side surface of an end plate; an orbiting scroll comprising a spiral-shaped wall portion disposed in an upright manner on a side surface of an end plate, the orbiting scroll being supported in a manner capable of orbiting motion with the two wall portions meshing while being prevented from self rotation; a discharge port through which a fluid compressed by the two scrolls is discharged; an end plate step portion provided on the end plate of both of the two scrolls formed on the side surfaces so that a height of the end plates is higher on a center portion side in the direction of a spiral of the wall portions and lower on an outer end side; and a wall portion step portion provided on the wall portion of both of the two scrolls that corresponds to the end plate step portions so that a height of the wall portions is lower on a center portion side of the spiral and higher on an outer end side; wherein the corresponding end plate step portions and the wall portion step portions have different heights; and the scroll comprising the highest end plate step portion out of the corresponding end plate step portions and the wall portion step portions is treated for surface hardening and the other scroll is not treated for surface hardening.

In an embodiment in which the end plate step portion is formed on both the fixed scroll and the orbiting scroll, wall portion step portions respectively corresponding to the end plate step portions are formed on the wall portions of the fixed scroll and the orbiting scroll, and the corresponding end plate step portions and the wall portion step portions respectively have different heights, the shapes of the fixed scroll and the orbiting scroll are asymmetrical and they do not have the same shape.

During orbiting motion with the fixed scroll and the orbiting scroll in mesh, the wall portion step portion and the end plate step portion are in contact and move relative to one another. The end plate step portion has a larger contact surface area. Accordingly, by treating the scroll with the highest end plate step portion for surface hardening, wear of the surface treatment can be significantly prevented, thus preventing seizure.

Additionally, the wall portion provided with the wall portion step portion experiences stress concentration at a root of the wall portion step portion. However, surface hardening treatment increases the surface roughness of the surface, thus the fatigue strength of the root of the wall portion step portion may be reduced. As such, the scroll including the highest wall portion step portion is not treated for surface hardening.

For the surface hardening treatment, for example, in embodiments in which the fixed scroll and the orbiting scroll are made of an aluminum alloy, hard alumite treatment may be used.

For example, in embodiments in which the end plate step portion provided on the orbiting scroll is higher than the end plate step portion provided on the fixed scroll, the orbiting scroll is treated for surface hardening and the fixed scroll is not treated for surface hardening.

A scroll compressor according to an embodiment of the present invention comprises: a fixed scroll comprising a spiral-shaped wall portion disposed in an upright manner on a side surface of an end plate; an orbiting scroll comprising a spiral-shaped wall portion disposed in an upright manner on a side surface of an end plate, the orbiting scroll being supported in a manner capable of orbiting motion with the two wall portions meshing while being prevented from self rotation; a discharge port through which a fluid compressed by the two scrolls is discharged; an end plate step portion provided on the end plate of one of the two scrolls formed on the side surface so that a height of the end plate is higher on a center portion side in the direction of a spiral of the wall portion and lower on an outer end side; and a wall portion step portion provided on the wall portion of the other of the two scrolls that corresponds to the end plate step portion so that a height of the wall portion is lower on a center portion side of a spiral of the wall portion and higher on an outer end side; wherein both of the scrolls are treated for surface hardening, with the scroll on which the end plate step portion is provided being treated to have a harder surface than that of the other scroll.

In an embodiment in which the end plate step portion is provided on the fixed scroll or the orbiting scroll and the wall portion step portion is provided on the other scroll, the shapes of the fixed scroll and the orbiting scroll are asymmetrical and they do not have the same shape.

During orbiting motion with the fixed scroll and the orbiting scroll in mesh, the wall portion step portion and the end plate step portion are in contact and move relative to one another. The end plate step portion has a larger contact surface area. Accordingly, by treating the scroll with the end plate step portion for surface hardening to have a harder surface than that of the other scroll, wear of the surface hardening treatment can be significantly prevented, thus preventing seizure.

In embodiments in which the fixed scroll and the orbiting scroll are made of an aluminum alloy, for the surface hardening treatment for the harder surface, Ni—P (nickel phosphorus) plating may be used, and for the other surface, Sn (tin) plating may be used, for example.

For example, in embodiments in which the end plate step portion is provided on the orbiting scroll and the wall portion step portion is provided on the fixed scroll, the orbiting scroll is treated for surface hardening to have a harder surface than that of the fixed scroll.

A scroll compressor according to an embodiment of the present invention comprises: a fixed scroll comprising a spiral-shaped wall portion disposed in an upright manner on a side surface of an end plate; an orbiting scroll comprising a spiral-shaped wall portion disposed in an upright manner on a side surface of an end plate, the orbiting scroll being supported in a manner capable of orbiting motion with the two wall portions meshing while being prevented from self rotation a discharge port through which a fluid compressed by the two scrolls is discharged; an end plate step portion provided on the end plate of both of the two scrolls formed on the side surfaces so that a height of the end plate is higher on a center portion side in the direction of a spiral of the wall portions and lower on an outer end side; and a wall portion step portion provided on the wall portion of both of the two scrolls that corresponds to the end plate step portions so that a height of the wall portions is lower on a center portion side of the spiral and higher on an outer end side; wherein the corresponding end plate step portions and the wall portion step portions have different heights; and both of the scrolls are treated for surface hardening treatment, with the scroll comprising the highest end plate step portion out of the corresponding end plate step portions and the wall portion step portions being treated to have a harder surface than that of the other scroll.

In an embodiment in which the end plate step portion is formed on both the fixed scroll and the orbiting scroll, wall portion step portions respectively corresponding to the end plate step portions are formed on the wall portions of the fixed scroll and the orbiting scroll, and the corresponding end plate step portions and the wall portion step portions respectively have different heights, the shapes of the fixed scroll and the orbiting scroll are asymmetrical and they do not have the same shape.

During orbiting motion with the fixed scroll and the orbiting scroll in mesh, the wall portion step portion and the end plate step portion are in contact and move relative to one another. The end plate step portion has a larger contact surface area. Accordingly, by treating the scroll with the highest end plate step portion for surface hardening to have a harder surface than that of the other scroll, wear of the surface treatment can be significantly prevented, thus preventing seizure.

In embodiments in which the fixed scroll and the orbiting scroll are made of an aluminum alloy, for the surface hardening treatment for the harder surface, Ni—P (nickel phosphorus) plating may be used, and for the other surface, Sn (tin) plating may be used, for example.

For example, in embodiments in which the end plate step portion provided on the orbiting scroll is higher than the end plate step portion provided on the fixed scroll, the orbiting scroll is treated for surface hardening to have a harder surface than that of the fixed scroll.

A scroll compressor according an embodiment of the present invention is configured such that Ls/Lout is 0.05 or greater, where Lout is a height of the wall portion formed with a greater height on the outer end side, and Ls is a height of the end plate step portion formed with a greater height on the center portion side.

The present inventors looked in Ls/Lout, a value of the height Ls of the end plate step portion on the center portion side divided by the height Lout of the wall portion on the outer end side. They found that when Ls/Lout is large, the dimensions of the step are increased. This may lead to a decrease in performance caused by an increase in the size of the path through which the compressed fluid can leak.

When Ls/Lout is small, the dimensions of the step are decreased. This may lead to the compression ratio being decreased and a decrease in the strength of the wall portion due to the height of the wall portion on the center portion side being relatively high. They discovered that Ls/Lout is preferably 0.05 or greater. Ls/Lout more preferably ranges from 0.05 to 0.3, and even more preferably ranges from 0.1 to 0.2.

Note that the height Lout of the wall portion formed to be higher on the outer end side specifically refers to the height of the wall portion with a step at the highest position (in other words, on the outer end side). The height Ls of the end plate step portion on the center portion side specifically refers to the height of the end plate with a step at the highest position measured from the lowest position of the end plate (in other words, on the outer end side).

Advantageous Effects of Invention

By treating the scroll provided with the end plate step portion or the scroll with the highest end plate step portion for surface hardening, wear of the surface hardening treatment can be reduced and seizure can be prevented.

By treating the scroll provided with the end plate step portion or the scroll with the highest end plate step portion for surface hardening to have a harder surface than the other scroll, wear of the surface hardening treatment can be reduced and seizure can be prevented.

DESCRIPTION OF EMBODIMENTS

Embodiments of the present invention will be described below with reference to the drawings.

Figure 1:
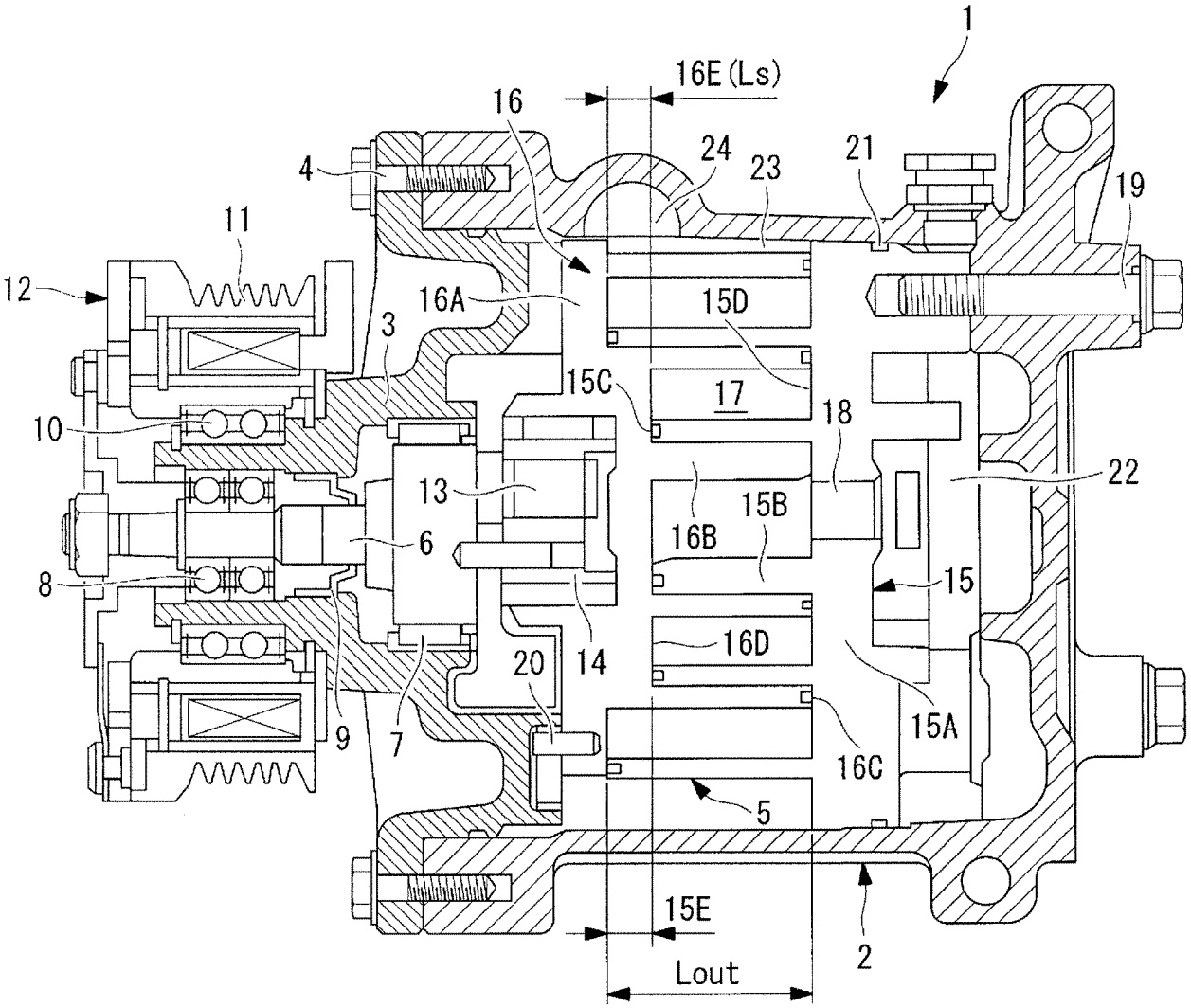
FIG. 1 is a vertical cross-sectional view of a scroll compressor according to an embodiment of the present invention.

As illustrated in FIG. 1, a scroll compressor 1 includes a housing 2 that defines the exterior of the scroll compressor 1. The housing 2 is a cylinder with an open front end side (left side in the drawing) and a sealed rear end side. By fastening and fixing a front housing 3 into the opening on the front end side using bolts 4, a sealed space is formed in the interior of the housing 2, and a scroll compression mechanism 5 and a drive shaft 6 are incorporated in the sealed space.

The drive shaft 6 is rotatably supported by the front housing 3 via a main bearing 7 and an auxiliary bearing 8. A pulley 11, which is rotatably provided on an outer circumferential portion of the front housing 3 via a bearing 10, is connected, via an electromagnetic clutch 12, to a front end portion of the drive shaft 6, which protrudes to the outside from the front housing 3 via a mechanical seal 9, such that motive power can be transmitted from an external source.

A crank pin 13, which is eccentric by a predetermined dimension, is integrally provided on the rear end of the drive shaft 6, and is connected to an orbiting scroll 16 of the scroll compression mechanism 5 described below, via a known slave crank mechanism 14 that includes a drive bushing and a drive bearing that enable a variable rotation radius.

In the scroll compression mechanism 5, a pair of compression chambers 17 are formed between a fixed scroll 15 and the orbiting scroll 16, the pair of compression chambers 17 opposing one another on either side of the center of the fixed scroll 15, as a result of the fixed and orbiting scrolls 15 and 16 being engaged with each other with a 180° phase difference. The scroll compression mechanism 5 is configured to compress a fluid (refrigerant gas) by moving each of the compression chambers 17 from an outer circumferential position toward a center position while gradually reducing the capacity thereof.

A discharge port 18, which discharges compressed gas, is provided in a center section of the fixed scroll 15, and the fixed scroll 15 is provided fixed on a bottom wall surface of the housing 2 via bolts 19. Further, the orbiting scroll 16 is connected to the crank pin 13 of the drive shaft 6 via the slave crank mechanism 14, and is supported by a thrust bearing surface of the front housing 3 via a known self-rotation prevention mechanism 20, such that the orbiting scroll 16 can freely orbit and turn.

An O-ring 21 is provided around the outer circumference of an end plate 15A of the fixed scroll 15. As a result of the O-ring 21 making close contact with the inner circumferential surface of the housing 2, the internal space of the housing 2 is partitioned into a discharge chamber 22 and an intake chamber 23.

The discharge port 18 opens into the discharge chamber 22. The compressed gas from the compression chambers 17 is discharged from the discharge port 18, and then discharged to a refrigeration cycle side therefrom.

An intake port 24, which is provided in the housing 2, opens into the intake chamber 23. A low-pressure gas, which has circulated through the refrigeration cycle, is, through the intake port 24, taken into the intake chamber 23, and then, the refrigerant gas is taken into the interior of the compression chambers 17 from the intake chamber 23.

The pair of the fixed scroll 15 and the orbiting scroll 16 include spiral wraps 15B and 16B integrally disposed in an upright manner on the end plate 15A and an end plate 16A, respectively, as wall portions. A blade tip surface 15C of the fixed scroll 15 is in contact with a blade base surface 16D of the orbiting scroll 16, and a blade tip surface 16C of the orbiting scroll 16 is in contact with a blade base surface 15D of the fixed scroll 15.

Figure 2:
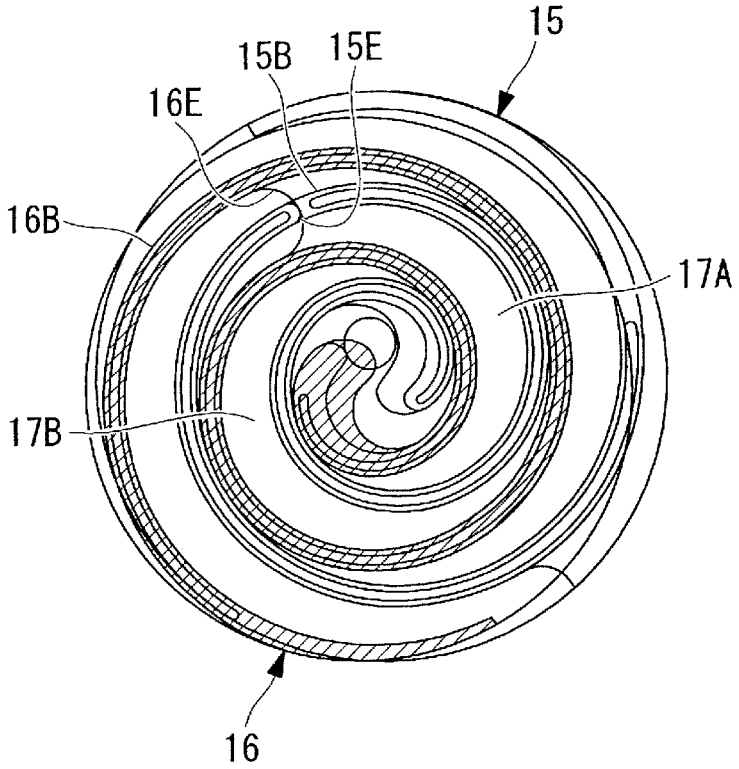
FIG. 2 is a horizontal cross-sectional view of how a fixed scroll and an orbiting scroll mesh.

An end plate step portion 16E is provided on the end plate 16A of the orbiting scroll 16 such that the height of the end plate 16A transitions from higher on the center portion side to lower on the outer end side in the spiral direction of the spiral wrap 16B. Specifically, as illustrated in FIG. 2, the end plate step portion 16E is provided at a position 180° from the position where the spiral wrap 16B of the orbiting scroll 16 ends.

A wrap step portion 15E is provided on the spiral wrap 15B of the fixed scroll 15 in a manner corresponding to the end plate step portion 16E of the orbiting scroll 16 described above, such that the height of the spiral wrap 15B transitions from lower on the center portion side of the spiral to higher on the outer end side. Specifically, as illustrated in FIG. 2, the wrap step portion 15E is provided at a position 360° from the position where the spiral wrap 15B of the fixed scroll 15 ends.

In other words, the end plate step portion 16E is only provided on the end plate 16A of the orbiting scroll 16, and the wrap step portion 15E is only provided on the spiral wrap 15B of the fixed scroll 15.

Thus, a step portion is not provided on the spiral wrap 16B of the orbiting scroll 16, and the tip end of the spiral wrap 16B is an even height, Additionally, a step portion is not provided on the end plate 15A of the fixed scroll 15, making the end plate 15A a flat surface.

Figure 6:
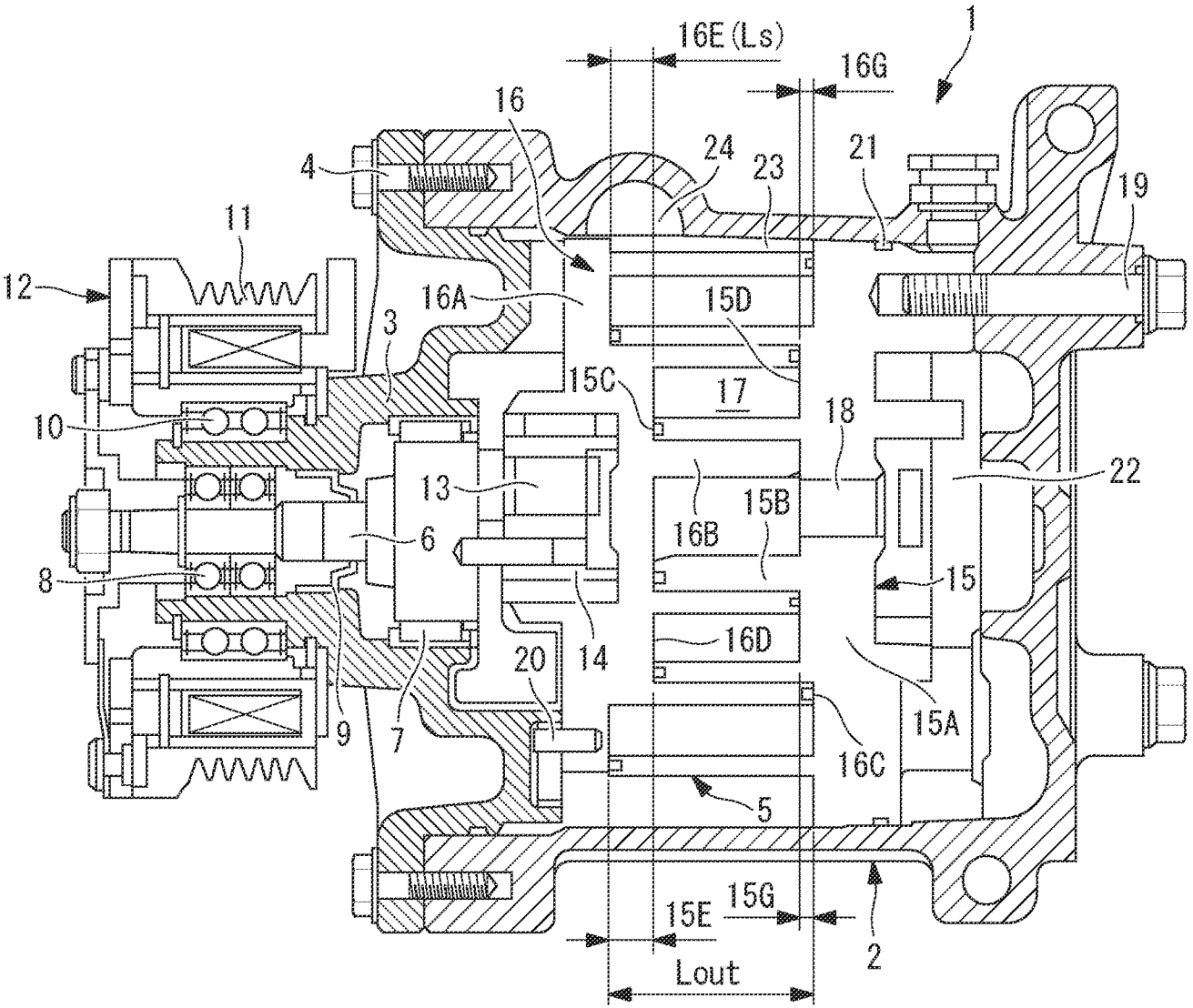
FIG. 6 is a vertical cross-sectional view of a scroll compressor according to an embodiment of the present invention.

FIG. 6 illustrates an embodiment similar to FIG. 1 except that the embodiment of FIG. 6 includes the fixed scroll 15 provided with an end plate step portion having a height lower than the end plate step portion 16E of the orbiting scroll 16, with respect to FIG. 1. FIG. 6 illustrates the scrolls having different height end plate step portions. As illustrated reference numeral "15G" denotes an end plate step portion provided on the fixed scroll 15, and reference numeral "16G" denotes a wrap step portion provided on the orbiting scroll 16.

As illustrated in FIG. 2, the compression chambers 17 are formed by at least a pair of compression chambers 17A, 17B that oppose one another on either side of the center of the fixed scroll 15.

The fixed scroll 15 and the orbiting scroll 16 described above are made of an aluminum alloy. The fixed scroll 15 is not treated for surface hardening, and after cutting and finishing, the aluminum alloy material ma-ices the outermost surface layer. The orbiting scroll 16 is treated for surface hardening via a hard alumite treatment.

Figure 3:
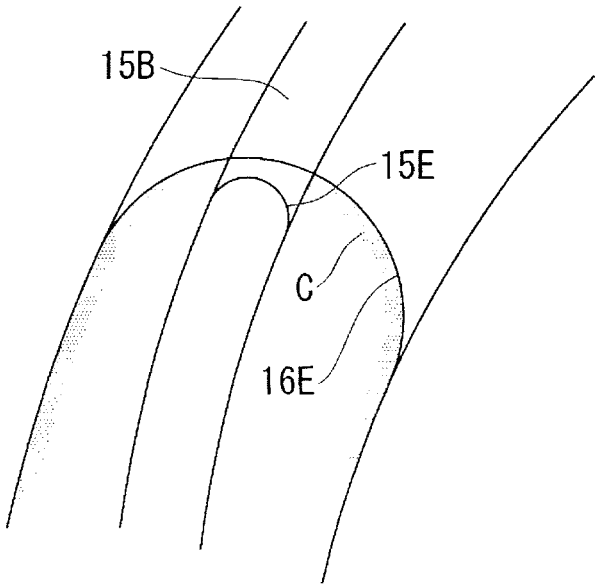
FIG. 3 is an enlarged horizontal cross-sectional view of an end plate step portion and a wrap step portion.
Figure 4:
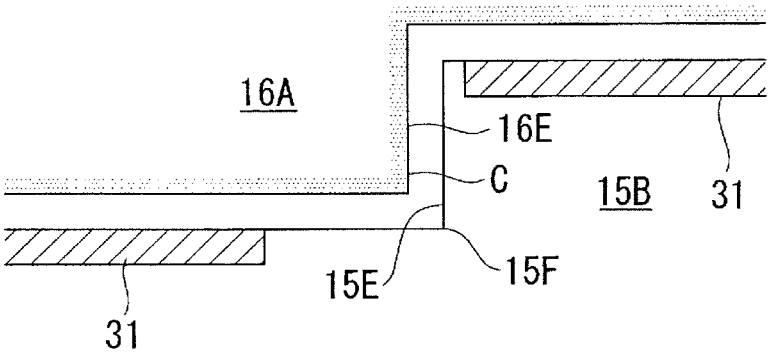
FIG. 4 is an enlarged vertical cross-sectional view of the end plate step portion and the wrap step portion.
Figure 5:
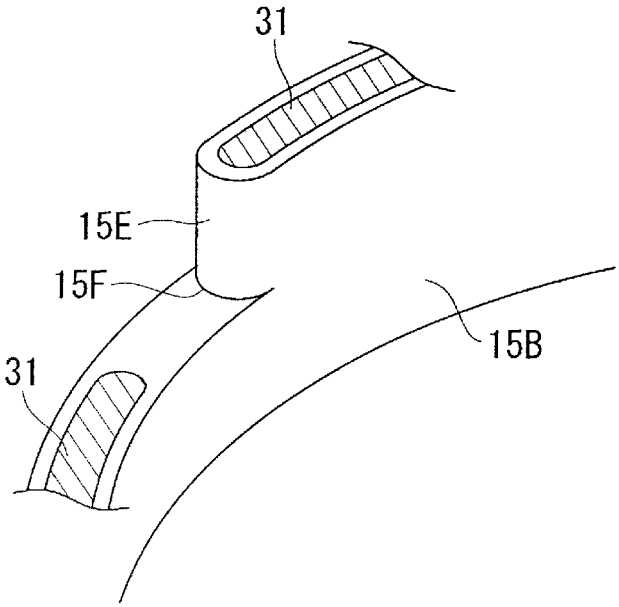
FIG. 5 is an enlarged perspective view of the wrap step portion.

Accordingly, as illustrated in FIGS. 3 and 4, a hard alumite layer C is formed on the end plate step portion 16E of the orbiting scroll 16, and the wrap step portion 15E of the fixed scroll 15 is not treated for surface hardening. FIG. 4 illustrates, in the configuration shown in FIG. 6, the state in which surface hardening treatment is applied only to the end plate step portion 16E.

When the orbiting scroll 16 orbits relative to the fixed scroll 15, as illustrated in FIG. 3, the end plate step portion 16E and the wrap step portion 15E move relative to one another while in contact. Thus, the curved surface of the tip end of the wrap step portion 15E comes into contact with the curved surface of the end plate step portion 16E, which has a larger radius.

Figure 7:
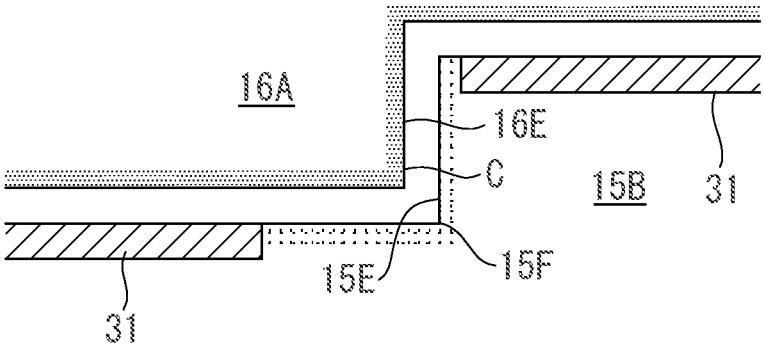
FIG. 7 is an enlarged vertical cross-sectional view of the end plate step portion and the wrap step portion.

For the surface hardening treatment, at least the area of the orbiting scroll 16 which comes into contact with the fixed scroll 15 is treated, and preferably the area including the entire of the spiral wrap 16B and the entire of the end plate 16A on the side where the spiral wrap 16B is provided is treated. The entire of the orbiting scroll 16 may of course be treated for surface hardening. As shown in the embodiment of FIG. 7, contrary to the embodiment of FIG. 4, the surface hardening treatment is also applied to the spiral wrap 15B of the fixed scroll 15. More specifically, FIG. 7 shows, in the configuration of FIG. 6, that the orbiting scroll 16 has a harder surface hardening treatment than the fixed scroll 15.

Note that the reference sign 31 in FIG. 4 denotes a tip seal for preventing fluid leakage disposed in the groove formed in the tip end of the spiral wrap 15B.

Ls/Lout is 0.05 or greater, where the height of the spiral wrap 15B formed to be higher on the outer end side of the fixed scroll 15, in other words the height on the outer side of the wrap step portion 15E, is Lout (see FIG. 1), and the height of the end plate step portion 16E formed to be higher on the center portion side of the orbiting scroll 16, in other words the height of the step on the center portion side of the end plate step portion 16E, is Ls (see FIG. 1). Additionally, Ls/Lout preferably ranges from 0.05 to 0.3, and more preferably from 0.1 to 0.2.

According to the scroll compressor 1 of the present embodiment, the following effects are achieved.

During orbiting motion with the fixed scroll 15 and the orbiting scroll 16 in mesh, the wrap step portion 15E and the end plate step portion 16E are in contact and move relative to one another. The end plate step portion 16E has a larger contact surface area than the wrap step portion 15E, which has a curved surface with a small radius than that of the end plate step portion 16E. Accordingly, by treating the end plate step portion 16E with hard alumite treatment, wear of the hard alumite layer C can be significantly prevented, thus preventing seizure.

Additionally, the spiral wrap 15B provided with the wrap step portion 15E experiences stress concentration at a root 15F of the wrap step portion 15E. However, hard alumite treatment increases the surface roughness of the surface, thus the fatigue strength of the root 15F of the wrap step portion 15E may be reduced. As such, fatigue strength can be improved by not treating the fixed scroll including the wrap step portion 15E for surface hardening.

The ratio Ls/Lout of the height Ls of the end plate step portion 16E on the center portion side divided by the height Lout of the spiral wrap 15B on the outer end side is 0.05 or greater, preferably ranges from 0.05 to 0.3, and more preferably ranges from 0.1 to 0.2. When Ls/Lout is large, the dimensions of the step are increased, and a decrease in performance may be caused by an increase in the size of the path through which the compressed fluid can leak. However, with such dimensions described above, the decrease in performance can be significantly prevented. When Ls/Lout is small and the dimensions of the step are decreased, the compression ratio is decreased and a decrease in the strength of the spiral wrap due to the height of the spiral wrap on the center portion side being relatively high may be caused. With such dimensions described above, the decrease in the strength can be significantly prevented.

Note that in the present embodiment described above, the end plate step portion 16E is only provided on the end plate 16A of the orbiting scroll 16 and the wrap step portion 15E is only provided on the spiral wrap 15B of the fixed scroll 15. However, in other embodiments of the present invention, the opposite may be the case with an end plate step portion being only provided on the end plate 15A of the fixed scroll 15 and a wrap step portion being only provided on the spiral wrap 16B of the orbiting scroll 16. In such an embodiment, the fixed scroll 15 is treated for surface hardening and the orbiting scroll 16 is not treated for surface hardening.

Additionally, in the present embodiment described above, the scrolls 15, 16 are made of an aluminum alloy. However, in embodiments in which the scrolls 15, 16 are made of cast iron or iron, phosphate coating or diamond-like coating (DLC) can be used for the surface hardening treatment.

In the present embodiment described above, only one scroll was treated for surface hardening. However, in other embodiments, both scrolls may be treated for surface hardening. In such embodiments, the scroll provided with the end plate step portion is treated for surface hardening to have a harder surface than that of the other scroll. For the surface treatment for the harder surface, Ni—P (nickel phosphorus) plating may be used, and for the other surface, Sn (tin) plating may be used, for example.

Additionally, in another embodiment, a scroll compressor such as that described in Patent Document 1 provided with an end plate step portion on the end plates of both the fixed scroll and the orbiting scroll may be employed. In other words, when the height of the end plate step portion provided on the end plate of the orbiting scroll is greater than that of the end plate step portion provided on the end plate of the fixed scroll, the orbiting scroll is treated for surface hardening and the fixed scroll is not treated for surface hardening. Alternatively, the orbiting scroll is treated for surface hardening treatment to have a harder surface than the fixed scroll.

When the height of the end plate step portion provided on the end plate of the fixed scroll is greater than that of the end plate step portion provided on the end plate of the orbiting scroll, the fixed scroll is treated for surface hardening and the orbiting scroll is not treated for surface hardening. Alternatively, the fixed scroll is treated for surface hardening treatment to have a harder surface than the orbiting scroll.

REFERENCE SIGNS LIST

1 Scroll compressor
15 Fixed scroll
16 Orbiting scroll
15A, 16A End plate
15B, 16B Spiral wrap
15C, 16C Blade tip surface
15D, 16D Blade base surface
15E Wrap step portion (wall portion step portion)
16E End plate step portion
17 Compression chamber
17A Front compression chamber
17B Back compression chamber

The invention claimed is:

1. A scroll compressor, comprising:

a fixed scroll comprising a spiral-shaped wall portion disposed in an upright manner on a side surface of an end plate;

an orbiting scroll comprising a spiral-shaped wall portion disposed in an upright manner on a side surface of an end plate, the orbiting scroll being supported in a manner capable of orbiting motion with the two wall portions meshing while being prevented from self rotation;

a discharge port through which a fluid compressed by the two scrolls is discharged;

an end plate step portion provided on the end plate of both of the two scrolls formed on the side surfaces so that a height of the end plates is higher on a center portion side in the direction of a spiral of the wall portions and lower on an outer end side; and a wall portion step portion provided on the wall portion of both of the two scrolls that corresponds to the end plate step portions so that a height of the wall portions is lower on a center portion side of the spiral and higher on an outer end side; wherein the end plate step portion of one of the scrolls and the end plate step portion of the other of the scrolls have different heights; and the scroll comprising the highest end plate step portion is treated for surface hardening and the other scroll is not treated for surface hardening.

2. The scroll compressor according to claim 1, wherein

Ls/Lout is 0.05 or greater, where Lout is a height of the wall portion formed with a greater height on the outer end side, and Ls is a height of the end plate step portion formed with a greater height on the center portion side.

3. A scroll compressor comprising:

a fixed scroll comprising a spiral-shaped wall portion disposed in an upright manner on a side surface of an end plate;

an orbiting scroll comprising a spiral-shaped wall portion disposed in an upright manner on a side surface of an end plate, the orbiting scroll being supported in a manner capable of orbiting motion with the two wall portions meshing while being prevented from self rotation;

a discharge port through which a fluid compressed by the two scrolls is discharged;

an end plate step portion provided on the end plate of one of the two scrolls formed on the side surface so that a height of the end plate is higher on a center portion side in the direction of a spiral of the wall portion and lower on an outer end side; and a wall portion step portion provided on the wall portion of the other of the two scrolls that corresponds to the end plate step portion so that a height of the wall portion is lower on a center portion side of a spiral of the wall portion and higher on an outer end side; wherein both of the scrolls are treated for surface hardening, with the scroll on which the end plate step portion is provided being treated to have a harder surface than that of the other scroll.

4. A scroll compressor comprising:

a fixed scroll comprising a spiral-shaped wall portion disposed in an upright manner on a side surface of an end plate;

an orbiting scroll comprising a spiral-shaped wall portion disposed in an upright manner on a side surface of an end plate, the orbiting scroll being supported in a manner capable of orbiting motion with the two wall portions meshing while being prevented from self rotation;

a discharge port through which a fluid compressed by the two scrolls is discharged;

an end plate step portion provided on the end plate of both of the two scrolls formed on the side surfaces so that a height of the end plate is higher on a center portion side in the direction of a spiral of the wall portions and lower on an outer end side; and a wall portion step portion provided on the wall portion of both of the two scrolls that corresponds to the end plate step portions so that a height of the wall portions is lower on a center portion side of the spiral and higher on an outer end side; wherein the end plate step portion of one of the scrolls and the end plate step portion of the other of the scrolls have different heights; and both of the scrolls are treated for surface hardening, with the scroll comprising the highest end plate step portion being treated for surface hardening to have a harder surface than that of the other scroll.

* * * * *